US006214512B1

(12) United States Patent
Takano et al.

(10) Patent No.: US 6,214,512 B1
(45) **Date of Patent: *Apr. 10, 2001**

(54) IMAGE FORMING METHOD

(75) Inventors: Hiroshi Takano; Yuka Ishihara; Takashi Imai; Masanori Ichimura, all of Minami-Ashigara (JP)

(73) Assignee: Fuji Xerox Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/006,819

(22) Filed: Jan. 14, 1998

(30) Foreign Application Priority Data

Jan. 17, 1997 (JP) ..... 9-007007

(51) Int. Cl.[7] ..... G03G 13/14
(52) U.S. Cl. ..... 430/126; 430/110
(58) Field of Search ..... 430/126, 110

(56) References Cited

U.S. PATENT DOCUMENTS

| | | | | |
|---|---|---|---|---|
| 2,221,776 | | 11/1940 | Carlson . | |
| 2,618,552 | | 11/1952 | Wise . | |
| 2,874,063 | | 2/1959 | Greig . | |
| 4,859,716 | * | 8/1989 | Ibsen et al. | 522/14 |
| 4,933,251 | * | 6/1990 | Ichimura et al. | 430/111 |
| 5,429,902 | * | 7/1995 | Saito et al. | 430/110 |
| 5,572,304 | * | 11/1996 | Seto et al. | 430/126 |
| 5,778,291 | * | 7/1998 | Okubo et al. | 399/302 |

FOREIGN PATENT DOCUMENTS

| | | |
|---|---|---|
| 6-202428 | 7/1994 | (JP) . |
| 8-211755 | 8/1996 | (JP) . |

* cited by examiner

*Primary Examiner*—Christopher D. Rodee
(74) *Attorney, Agent, or Firm*—Oliff & Berridge, PLC

(57) ABSTRACT

In an image forming method having the step of developing an electrostatic latent image on an electrostatic latent image carrying member using a toner layer on a developer carrying member, the step of transferring the developed toner image onto a belt transfer body 7 which is a first transfer body, and the step of transferring the toner image formed on the belt transfer body 7 onto a second transfer body 11, the surface resistance of the belt transfer body 7 is $10^8$ to $10^{15}$ Ω·cm, the toner is composed of at least resin particles containing a binding resin and a coloring material, and an additive, and the additive contains particles whose volume resistance is $10^7$ to $10^{13}$ Ω·cm.

20 Claims, 1 Drawing Sheet

IMAGE FORMING METHOD

BACKGROUND OF THE INVENTION

1. Field of the Invention

The present invention relates to an image forming method including the steps of developing an electrostatic latent image and transferring a toner image onto a belt transfer body.

2. Description of the Related Art

As conventional methods of visualizing an electrostatic latent image formed on a photoconductive photoreceptor or the like by using toner in the electrophotographic method, for example, a magnetic brush method described in U.S. Pat. No. 2,874,063, a cascade method described in U.S. Pat. No. 2,618,552, the powder cloud method described in U.S. Pat. No. 2,221,776, etc. have been known. Meanwhile, in cases where a multi-color image is obtained by the electronic needling method, a method in which colors are superposed successively for each color by repeating the charging, exposure, development and cleaning processes is used. In this method, a multi-color image is formed on a transfer drum having a drum shape, and thus the problem arose of the apparatus to house the drum. In order to solve this problem, making the image forming apparatus smaller has been attempted by using a flexible belt-shaped transfer body (hereinafter, referred to as "belt transfer body").

As a developer for developing an electrostatic latent image using the electrophotographic method, a two-component developer composed of a toner and a carrier is often used. Various carriers are used in the two-component developer, typical examples being an electroconductive carriers such as iron oxide powder, and coat-type insulating carriers. Further, a toner, which is obtained by mixing a coloring material with a thermoplastic resin is generally used. Furthermore, various organic and inorganic fine powders added as additives give process adaptability by improving flow, charge, and cleaning properties, and the like. Examples of powders proposed for this use include fine powders of silicon oxide (silica), titanium oxide, alumina, and tin oxide. In particular, titanium oxide fine powder has been frequently used in recent years because of its excellent environmental reliability, electric charge exchangeability, and flowability when added to the toner externally.

In recent years, longer life of the developer is desired. Therefore, in order to lower non-electrostatic adhesion between the toner and carrier, and prevent contamination of the carrier by the toner, it is suggested that the surface of the carrier be coated with a fluorine-containing resin so that the life of the developer may be lengthened.

Further, the need for high image quality has increased in recent years, and thus various improvements in image forming apparatuses and developers have been tried in order to satisfy such needs. An image forming apparatus includes development, transfer, cleaning, and fixing process, but particularly in the transfer process, an image is deteriorated remarkably, and in an image forming apparatus using a belt transfer body, a sufficiently high image quality has not been yet obtained. Moreover, when an image is copied on plural sheets of paper with a low image density, the developer deteriorates, and thus problems arise such as the transfer efficiency being lowered.

SUMMARY OF THE INVENTION

The present invention solves the aforementioned problems. Namely, it is an object of the present invention to provide an image forming method which is capable of suppressing image deteriorations such as scattering of toner and unsatisfactory dot reproducibility occurring in the transfer process using a belt transfer body, as well as suppressing unsatisfactory transfer due to copying an image onto plural sheets of paper with a low image density, and lowering of transfer efficiency, and of obtaining a stable, high image quality even over a long period of use.

The inventors finished the present invention after making an examination to solve the aforementioned problems of the conventional technique. Namely, the present invention provides an image forming method having the steps of developing an electrostatic latent image on an electrostatic latent image carrying member using a toner layer on a developer carrying member, transferring the developed toner image onto a belt transfer body which is a first transfer body, and transferring the toner image formed on the belt transfer body onto a second transfer body. The image forming method is characterized in that surface resistance of the belt transfer body is $10^8$ to $10^{15}$ Ω·cm, and the toner is composed of at least resin particles containing a binding resin and coloring material, and an additive, and the additive contains particles whose volume resistance of is $10^7$ to $10^{13}$ Ω·cm.

DETAILED DESCRIPTION OF THE PREFERRED EMBODIMENTS

Figure 1:
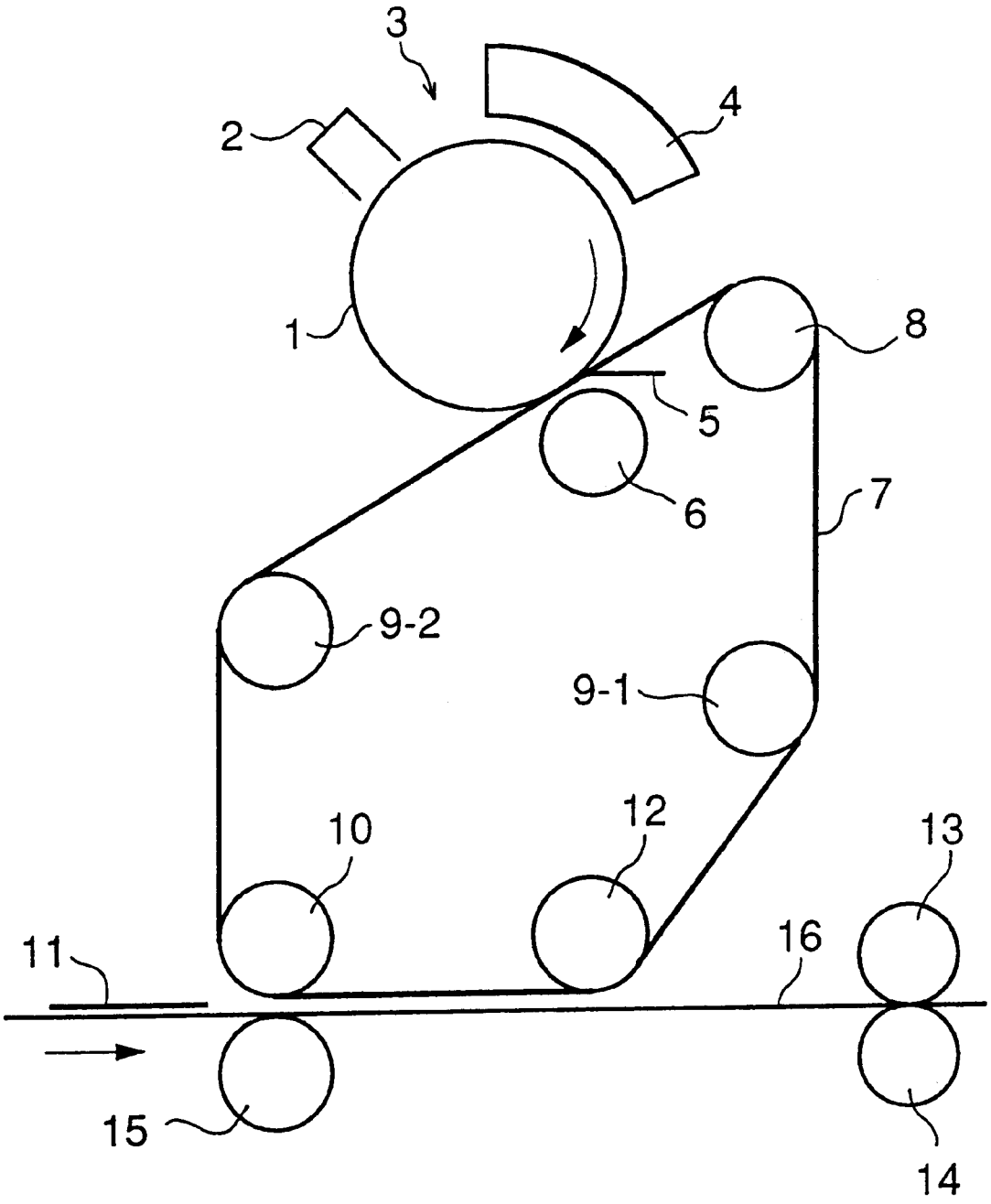
FIG. 1 is a schematic structural drawing showing one example of an image forming apparatus adopting the image forming method of the present invention.

The embodiments of the present invention will now be described in greater detail.

In the present invention, the image forming method which includes the process of developing an electrostatic latent image on an electrostatic latent image carrying member using a toner layer on a developer carrying member, the process of transferring the developed toner image onto a belt transfer body which is a first transfer body, and the process of transferring the toner image formed on the belt transfer body onto a second transfer body, has the characteristics that the volume resistance of an additive in the toner, and the surface resistance of the belt transfer body are defined.

FIG. 1 is a schematic structural drawing showing one example of an image forming apparatus adopting the image forming method of the present invention. In FIG. 1, 1 is an electrostatic latent image carrying member, 2 is a charging device, 3 is an exposure device, 4 is a developing device, 5 is a baffle, 6 is a transfer roll, 7 is a belt transfer body, 8 is a driving roll, 9-1 and 9-2 are tension rolls, 10 is a transfer roll, 11 is recording paper, 12 is a peeling roll, 13 is a fixing roll, 14 is a pressure roll, 15 is a transfer roll, and 16 is a recording paper transporting member. In the image forming apparatus shown in FIG. 1, an electrostatic latent image, which was formed on the surface of the electrostatic latent image carrying member 1 by the charging device 2 and exposure device 3, is developed by the developing device 4 by using a toner layer on a developer carrying member (not shown) into a toner image, and the toner image is transferred onto the surface of the belt transfer body 7 which is the first transfer body by the transfer roll 6. The toner image formed on the surface of the belt transfer body 7 is transferred onto the recording paper 11 which is the second transfer body by the transfer rolls 10 and 15 in a secondary transfer portion. The recording paper 11 is transported by the recording paper transport member 16 to be heat fixed by the fixing roll 13 and pressure roll 14. In the above manner, the image is recorded on the recording paper 11.

First, the belt transfer body constituting the present invention will be described.

As the material of the belt transfer body, comparatively hard resins are preferable, so publicly known resins such as polyamide resin, polyurethane resin, polyester resin, epoxy resin, polyketone resin, polycarbonate resin, polyvinyl ketone resin, polystyrene resin, polyacrylamide resin, polyimide resin, polyamidoimide resin and polyetherimide resin can be used. Moreover, as a material used for controlling the resistance, an inorganic material such as carbon black, a metallocene compound such as N, N'-dimethyl ferrocene, an aromatic amine compound such as N,N'-diphenyl-N,N'-bis (3-methylphenyl)-[1,1-biphenyl]-4,4'-diamine, metallic oxide such as antimony oxide, tin oxide, titanium oxide, indium oxide, tin oxide-antimony oxide, etc. can be used, but the material is not limited to them.

It is necessary that in the present invention, the surface resistance of the belt transfer body is in the range of $10^8$ to $10^{15}$ Ω·cm. When the surface resistance is lower than $10^8$, the electric charge leaks when the transfer electric current is applied, and thus insufficient dot reproduction occurs and the transfer efficiency is lowered. Moreover, when the surface resistance is greater than $10^{15}$, discharge occurs, and thus loss of image around a character occurs. It is particularly preferable that the surface resistance of the belt transfer body is in the range of $10^{10}$ to $10^{14}$Ω·cm.

The thickness of the belt transfer body is not particularly limited, but since certain strength and elasticity are required, a range of 50 to 220 μm is preferable, and the thickness may be determined suitably according to the material used. It is preferable that the linear pressure of the primary transfer for transferring a toner image from a sensitive material onto the belt transfer body is in the range of 10 to 30 g/cm. If the linear pressure is lower than 10 g/cm, insufficient transfer occurs, and if the linear pressure is higher than 30 g/cm, the toner remains on the sensitive material, and image voids occur. It is more preferable that the linear pressure is in the range of 15 to 25 g/cm. Moreover, it is preferable that the linear pressure of the secondary transfer for transferring a toner image from the belt transfer body onto an image carrying member such as paper is in the range of 70 to 170 g/cm. If the linear pressure is lower than 70 g/cm, insufficient transfer and insufficient peeling of the image carrying member occur, and if the linear pressure is higher than 170 g/cm, toner remains on the sensitive material, and image voids occur. It is more preferable that the linear pressure is in the range of 100 to 140 g/cm.

Next, the toner constituting the present invention will be described.

The toner to be used in the present invention is composed of at least resin particles including a binding resin and a coloring material, and an additive.

As the binding resin to be used, homopolymers and copolymers can be used, for example styrenes such as styrene, and chlorostyrene; monoolefins such as ethylene, propylene, butylene, and isobutylene, vinylesters such as vinyl acetate, vinyl propionate, vinyl benzoate, and vinyl butyrate; esters of α-methylene aliphatic monocarboxylic acid such as methyl acrylate, ethyl acrylate, butyl acrylate, octyl acrylate, dodecyl acrylate, phenyl acrylate, methyl methacrylate, ethyl methacrylate, butyl methacrylate and dodecyl methacrylate; vinylethers such as vinyl methylether, vinyl ethylether, and vinylbutylether; vinyl ketones such as vinyl methylketone, vinyl hexylketone, and vinyl isopropenylketone. As a particularly typical binding resin, polystyrene, styrene-alkylacrylate copolymer, styrene-alkylmethacrylate copolymer, styrene-acrylonitrile copolymer, styrene-butadiene copolymer, styrene-maleic anhydride copolymer, polyethylene and polypropylene can be used. Further, polyester, polyurethane, epoxy resin, silicone resin, polyamide, modified rosin, paraffin wax, and the like can be used.

Examples of the coloring material to be used are carbon black, aniline blue, chalcoil blue, chrome yellow, ultramarine blue, Du Pont oil red, quinoline yellow, methylene blue chloride, copper phthalocyanine, malachite green oxalate, lampblack, rose bengal, C.I. Pigment Red 48:1, C.I. Pigment Red 122, C.I. Pigment Red 57:1, C.I. Pigment Red 81:1, C.I. Pigment Yellow 97, C.I. Pigment Yellow 12, C.I. Pigment Yellow 17, C.I. Pigment Blue 15:1, C.I. Pigment Blue 15:3.

The toner particles to be used in the present invention can be obtained by heating and kneading the aforementioned binding resins and coloring materials according to the usual method and after cooling them, pulverizing and classifying them. It is preferable that the volume average particle diameter of the resin particles is in the range of about 3 to 15 μm, and the range of about 3 to 9 μm is more preferable. When the volume average particle diameter is smaller than 3 μm, fogging on non-image portions is occasionally severe, and when the volume average particle diameter is larger than 15 μm, image quality is occasionally reduced, so these cases are not preferable.

As the additive to be used in the present invention, inorganic oxide fine particles are preferably used. Examples thereof include fine particles of silicon dioxide ($SiO_2$), titanium oxide ($TiO_2$), $Al_2O_3$, $Fe_2O_3$, MnO, ZnO, MgO, CaO, $K_2O$, $Na_2O$, $SnO_2$, $ZrO_2$, $CaO{\cdot}SnO_2$, and $K_2O$ $(TiO_2)$ n, or else fine particles of these elements whose surfaces have been treated with a silane coupling agent such as hexamethyldisilazane, trimethoxydecylsilane, amino-modified silane, and the like, a titanium coupling agent, silicone oil, modified silicone oil, or resin, or else fine particles of these elements to which a charge control agent has been added, and the like.

Further, besides the aforementioned components, charge control agents and cleaning auxiliaries can be included as the need arises. The average particle diameter of the inorganic oxide fine particles to be used in the present invention is preferably in the range of about 3 nm to 1 μm, and more preferably in the range of 5 nm to 100 nm. These inorganic oxide fine particles can be used singly or in combination. Moreover, organic fine particles can be also used, but when organic fine particles are used singly, the flowability of the toner is deteriorated and thus there is insufficient transportation. For this reason, it is desirable that the organic fine particles are used together with the inorganic oxide fine participles. In the present invention titanium oxide and silicon dioxide are preferably used as the additives, and it is more preferable that they are used in combination.

In the present invention, examples of the titanium oxide to be used as an additive or as a kind of additive are a rutile type, an anatase type, or these types having undergone a hydrophobic treatment, or else these types having undergone a hydrophobic treatment from a metatitanic acid ($H_2TiO_3$) state.

In the present invention, it is necessary that the volume resistance of the particles of at least one kind of additive is in the range of $10^7$ to $10^{13}$ Ω·cm. When the volume resistance is lower than $10^7$ Ω·cm, electric charges are injected into the toner when the transfer electric currents are applied, and a reverse transferring phenomenon occurs in which the toner is retransferred onto the electrostatic latent image carrying member so that the transfer efficiency is lowered remarkably. Moreover, when the volume resistance is higher than $10^{13}$ Ω·cm, the toner charge rises, and a toner scattering phenomenon called blur occurs on the belt transfer body, thereby causing a deterioration in image quality. In the present invention, as the particles of the additive whose volume resistance is in the range of $10^7$ to $10^{13}$ Ω·cm, it is particularly desirable that titanium oxide is used. In particular, titanium oxide whose volume resistance is not less than $10^8$ Ω·cm is preferably used. Moreover, in the present invention, it is preferable that the volume resistance of the particles of at least one kind of additive is higher than the surface resistance of the belt transfer body. A transfer voltage can be applied uniformly to the toner by setting the volume resistance to the aforementioned range, and thus transfer is performed satisfactorily.

When titanium oxide and silicon oxide are used in combination as additives in the present invention, it is preferable that at least one kind of the silicon oxide to be used has a larger average particle diameter than the titanium oxide, and it is more preferable that its average particle diameter is in the range of 20 to 100 nm. This silicon oxide is used as a transfer auxiliary. When the average particle diameter is smaller than 20 nm, the silicon oxide is embedded into the toner due to the stress in a developing device, and thus the transfer efficiency is deteriorated. Moreover, when the average particle diameter is larger than 100 nm, the flowability of the toner is lowered, thereby causing problems such as insufficient transportation, etc.

The aforementioned toner is mixed with a carrier in the image forming method of the present invention as the two-component developer. It is preferable that the mixing ratio of the toner to the carrier is in a range of 0.3 to 30 weight % of the whole developer.

The carrier to be used in the present invention is not particularly limited, examples are magnetic particles such as iron powder and ferrite, resin coated carrier particles obtained by coating the surfaces of magnetic particles as core materials with publicly known resins such as styrene resins, vinyl resins, polyamide resins, rosin resins, polyester resins, polyolefin resins, fluororesins and silicone resins to form coated layers, or magnetic substance dispersed carrier particles obtained by dispersing magnetic fine particles in a binding resin. In the present invention, it is preferable that the resin coated carrier particles are used because the resistance of the developer can be controlled easily, and satisfactory development can be obtained.

Further, in order to obtain sufficient transfer efficiency, it is necessary to control the charge amount of the toner as well as the quantity of the toner on the electrostatic latent image carrying member. It is preferable that the absolute value of the charge amount of the toner to be used in the present invention is in the range of 15 μc/g to 40 μc/g. When the charge amount is smaller than 15 μc/g, clouding and fogging occur. When the charge amount is larger than 40 μc/g, the toner on the developed image carrying member cannot be transferred sufficiently. Moreover, it is desirable that there is less than 0.8 mg of toner per $cm^2$ on the developed image carrying member. When there is more than 0.8 mg of toner per $cm^2$, the transfer electric current does not sufficiently reach the toner in the lower layer levels, and thus the transfer efficiency is lowered and image quality is deteriorated.

EXAMPLES

The present invention is now explained specifically using the examples below, but the present invention is not limited to these examples. In the following description, all "parts" mean "part by weight".

Example 1

(Toner)

| | |
|---|---|
| Polyester binder polymer (terephthalic acid/cyclohexane diol/bisphenol A ethylene oxide adduct (molar ratio 50:30:20), Mw: 10,000, Mn: 3500, Tg: 65° C. | 86.7 parts |
| Coloring material (wet cake of C.I. Pigment Red 57:1 and the aforementioned polyester binder polymer are subjected to the pigment dispersion process in the ratio of 30 parts (non-aqueous solid content of pigment): 70 parts using a heat kneader) | 13.3 parts (4.0 parts as pigment) |

The aforementioned components were kneaded by a biaxial kneader, then pulverized and classified so that toner particles whose volume average particle diameter was 6.5 μm were obtained. D16/D50 (vol.) at this time was 1.21, and D50/D84 (pop.) was 1.40. 0.7 parts of silicon oxide fine particles with an average particle diameter of 40 nm whose surface was treated with hexamethyl disilane was added to 100 parts of the obtained toner particles, and 0.7 parts of titanium oxide fine particles with an average particle diameter of 15 nm whose surface was treated with trimethoxydecylsilane was added thereto, and they were mixed together with a Henschel mixer. Thereafter, toner sieving was conducted with a sieving apparatus with a mesh of 45 μm.

The volume resistance of the titanium oxide fine particles at this time was adjusted to $10^{12}$ Ω·cm by the amount of the surface treatment agent. Here, the resistance was measured according to a method in which a molded sample is sandwiched between parallel electrodes.

(Carrier)

| | |
|---|---|
| Cu—Zn-Ferrite core (volume average particle diameter: 35 μm) | 100 parts |
| Acrylic polymer containing fluorine (perfluorooctyl ethyl methacrylate - methylmethacrylate copolymer (copolymeric ratio 20:80, Mw = 50000)) | 0.5 parts |

The aforementioned components were kneaded by the kneader and dried so that carrier particles with a volume average particle diameter of about 35 μm were obtained.

(Developer)

The aforementioned toner and carrier were mixed with a weight ratio of 10:100 so that a magenta developer was prepared.

(Belt transfer body)

The belt transfer body was prepared using a polyimide resin with a thickness of 80 μm so that its surface resistance was $10^{10}$ Ω·cm through the addition of carbon black. The resistance was measured by a method based on ASTM D257.

(Developing device)

A belt transfer body A-color 935 (made by Fuji Xerox Co., Ltd) was remodeled into the aforementioned belt transfer body (hereinafter, referred to as "A-color 935 remodeled device"), and the remodeled device was used as a developing device. Moreover, a transfer roll was used for transferring from the photoreceptor onto the belt transfer body, and the transfer was carried out with the linear pressure being 15 g/cm. A transfer roll was used for the transfer from the belt transfer body onto paper with the linear pressure being 120 g/cm.

(Developing test)

Development on 100,000 sheets of paper was carried out by the aforementioned developer and A-color 935 remodeled device by using a gradation chart. At this time, the absolute value of the toner charge amount in the developer was 30 μc/g. Moreover, the amount of developed toner per unit area on the electrostatic latent image carrying member at the maximum density (hereinafter, referred to as simply "developed toner amount") was 0.5 mg/cm$^2$. At this time, the transfer efficiency was measured, and image quality after the development of 50,000 sheets of paper and 100,000 sheets of paper was evaluated. The results are shown in Table 1. Now, the method of measuring the transfer efficiency and the method of evaluating image quality will be described below.

(Method of measuring transfer efficiency)

As to the transfer efficiency, a toner image on the electrostatic latent image carrying member was taken off by adhesive tape or the like, and its weight was measured, then after a toner image was formed after the secondary transfer, the amount of toner of the toner image was measured, and the ratio of the latter numerical value to the former numerical value was determined as the transfer efficiency.

(Method of evaluating image quality)

The image quality was visually evaluated for defects in image quality such as scattering of toner and insufficient dot reproducibility. The criteria of judgment are as follows:

○: satisfactory image quality

Δ: defect in image quality is found, but it is allowable as a recorded image

X: defect in image quality is found, image quality is deteriorated, and it is not allowable as a recorded image.

Example 2

A developer was prepared and the developing test was made in the same manner as Example 1 except that C.I. Pigment Blue 15:3 was used as the coloring material and the resistance of the titanium oxide fine particles was $10^{11}$ Ω·cm. The results are shown in Table 1.

Example 3

A developer was prepared and the developing test was made in the same manner as Example 2 except that the resistance of the titanium oxide fine particple was $10^{13}$ Ω·cm. The results are shown in Table 1.

Example 4

A developer was prepared and the developing test was made in the same manner as Example 1 except that the surface resistance of the belt transfer body of the A-color 935 remodeled device was $10^8$ Ω·cm. The results are shown in Table 1.

Example 5

A developer was prepared and the developing test was made in the same manner as Example 1 except that the surface resistance of the belt transfer body of the A-color 935 remodeled device was $10^{11}$Ω·cm. The results are shown in Table 1.

Example 6

A developer was prepared and the developing test was made in the same manner as Example 1 except that silicon oxide fine particles with an average particle diameter of 20 nm were used. The results are shown in Table 1.

Example 7

A developer was prepared and the developing test was made in the same manner as Example 1 except that silicon oxide fine particles with an average particle diameter of 100 nm were used. The results are shown in Table 1.

Example 8

A developing test was made in the same manner as Example 1 except that the developing electric potential of the A-color 935 remodeled device was changed and the toner charge amount in the developer was 15 μc/g. The results are shown in Table 1.

Example 9

A developing test was made in the same manner as Example 1 except that the developing electric potential of the A-color 935 remodeled device was changed and the toner charge amount in the developer was 40 μc/g. The results are shown in Table 1.

Example 10

A developing test was made in the same manner as Example 1 except that the concentration of toner in the developer was changed so that the amount of developed toner was 0.8 mg/cm$^2$. The results are shown in Table 1.

Comparative Example 1

A developer was prepared and the developing test was made in the same manner as Example 1 except that the volume resistance of the titanium oxide fine particles was $10^6$ Ω·cm. The results are shown in Table 1.

Comparative Example 2

A developer was prepared and the developing test was made in the same manner as Example 1 except that the volume resistance of the titanium oxide fine particles was $10^{14}$ Ω·cm. The results are shown in Table 1.

Comparative Example 3

A developer was prepared and the developing test was made in the same manner as Example 1 except that the surface resistance of the belt transfer body of the A-color 935 remodeled device was $10^7$ Ω·cm. The results are shown in Table 1.

Comparative Example 4

A developer was prepared and the developing test was made in the same manner as Example 1 except that the surface resistance of the belt transfer body of the A-color 935 remodeled device was $10^{16}$ Ω·cm. The results are shown in Table 1.

Example 11

A developer was prepared and the developing test was made in the same manner as Example 1 except that silicon oxide fine particles with an average particle diameter of 15 nm were used. The results are shown in Table 1.

Example 12

A developer was prepared and the developing test was made in the same manner as Example 1 except that silicon oxide fine particles with an average particle diameter of 105 nm were used. The results are shown in Table 1.

the A-color 935 remodeled device was changed and the toner charge amount in the developer was 41 μc/g. The results are shown in Table 1.

Example 15

A developing test was made in the same manner as Example 1 except that the concentration of toner in the developer was changed so that the developed toner amount was 0.85 mg/cm$^2$. The results are shown in Table 1.

Example 16

A developer was prepared and the developing test was made in the same manner as Example 1 except that titanium oxide with an average particle diameter of 20 nm, which was taken out by treating a metalitanic acid state with 5 weight% of isobutyl silane. The results are shown in Table 1.

TABLE 1

| | Volume resistance of titanium oxide (Ω · cm) | Particle diameter of silicon oxide (nm) | Surface resistance of belt transfer body (Ω · cm) | Toner charge amount (μc/g) | DMA※ (mg/cm$^2$) | Transfer efficiency (%) | Defect in image quality 50,000 sheets of paper | Defect in image quality 100,000 sheets of paper | Remarks |
|---|---|---|---|---|---|---|---|---|---|
| Example 1 | $10^{12}$ | 40 | $10^{10}$ | 30 | 0.5 | 90 | ○ | ○ | None |
| Example 2 | $10^{11}$ | 40 | $10^{10}$ | 30 | 0.5 | 80 | ○ | ○ | None |
| Example 3 | $10^{13}$ | 40 | $10^{10}$ | 30 | 0.5 | 90 | ○ | ○ | None |
| Example 4 | $10^{12}$ | 40 | $10^{8}$ | 30 | 0.5 | 90 | ○ | ○ | None |
| Example 5 | $10^{12}$ | 40 | $10^{11}$ | 30 | 0.5 | 90 | ○ | ○ | None |
| Example 6 | $10^{12}$ | 20 | $10^{10}$ | 30 | 0.5 | 80 | ○ | ○ | None |
| Example 7 | $10^{12}$ | 100 | $10^{10}$ | 30 | 0.5 | 95 | ○ | ○ | None |
| Example 8 | $10^{12}$ | 40 | $10^{10}$ | 15 | 0.5 | 93 | ○ | ○ | None |
| Example 9 | $10^{12}$ | 40 | $10^{10}$ | 40 | 0.5 | 85 | ○ | ○ | None |
| Example 10 | $10^{12}$ | 40 | $10^{10}$ | 20 | 0.5 | 95 | ○ | ○ | None |
| Comparative Example 1 | $10^{6}$ | 40 | $10^{10}$ | 30 | 0.5 | 50 | X | X | Low-density image |
| Comparative Example 2 | $10^{14}$ | 40 | $10^{10}$ | 30 | 0.5 | 80 | X | X | Considerable line blurring and toner scattering |
| Comparative Example 3 | $10^{12}$ | 40 | $10^{7}$ | 30 | 0.5 | 80 | X | X | Unsatisfactory dot reproducibility |
| Comparative Example 4 | $10^{12}$ | 40 | $10^{16}$ | 30 | 0.5 | 60 | X | X | Unsatisfactory level of image clearness around a character |
| Example 11 | $10^{12}$ | 15 | $10^{10}$ | 30 | 0.5 | 90 | ○ | Δ | Unsatisfactory image evenness of solid portion after 100,000 sheets |
| Example 12 | $10^{12}$ | 105 | $10^{10}$ | 30 | 0.5 | 95 | ○ | Δ | Reduced density after 100,000 sheets |
| Example 13 | $10^{12}$ | 40 | $10^{10}$ | 14 | 0.5 | 90 | ○ | Δ | Fogging occurs after 100,000 sheets |
| Example 14 | $10^{12}$ | 40 | $10^{10}$ | 41 | 0.5 | 82 | Δ | ○ | None |
| Example 15 | $10^{12}$ | 40 | $10^{10}$ | 15 | 0.85 | 75 | ○ | ○ | None |
| Example 16 | $10^{12}$ | 40 | $10^{10}$ | 30 | 0.5 | 90 | ○ | ○ | None |

※DMA: developed toner amount per unit area on the electrostatic latent image carrying member at the maximum density.

Example 13

A developing test was made in the same manner as Example 1 except that the developing electric potential of the A-color 935 remodeled device was changed and the toner charge amount in the developer was 14 μc/g. The results are shown in Table 1.

Example 14

A developing test was made in the same manner as Example 1 except that the developing electric potential of As is clear from the above results, it was found that the image forming method of the present invention shows excellent effects such as the deterioration in image quality during transfer being suppressed and the transfer efficiency being improved.

As mentioned above, according to the image forming method of the present invention, deteriorations in image quality such as scattering of toner and unsatisfactory dot reproducibility occurring during the transfer process using the belt transfer body, and unsatisfactory transfer and lowering of the transfer efficiency caused by copying an image onto a plurality of sheets of paper with a low-image density are suppressed, and a stable, high image quality can be obtained even over a long period of use.

What is claimed is:

1. An image forming method comprising the steps of:

developing an electrostatic latent image on an electrostatic latent image carrying member using a toner layer on a developer carrying member;

transferring the developed toner image onto a belt transfer body which is a first transfer body; and transferring the toner image formed on the belt transfer body onto a second transfer body, wherein surface resistance of said belt transfer body is $10^8$ to $10^{15}$ Ω·cm, and said toner is composed of at least resin particles containing a binding resin and coloring material, and an additive, and the additive contains particles whose volume resistance is $10^7$ to $10^{12}$ Ω·cm, and wherein the volume resistance of said additive is higher than the surface resistance of the belt transfer body.

2. The image forming method according to claim 1, wherein the volume resistance of said additive is $10^8$ to $10^{12}$ Ω·cm.

3. The image forming method according to claim 2, wherein said additive is an inorganic oxide.

4. The image forming method according to claim 3, wherein the average particle diameter of said additive is 3 nm to 1 μm.

5. The image forming method according to claim 4, wherein said additive contains titanium oxide.

6. The image forming method according to claim 5, wherein said additive further contains silicon oxide.

7. The image forming method according to claim 6, wherein the average particle diameter of said silicon oxide is larger than the average particle diameter of the titanium oxide with which it is combined.

8. The image forming method according to claim 7, wherein the average particle diameter of said silicon oxide is 20 to 100 nm.

9. The image forming method according to claim 1, wherein the surface resistance of said belt transfer body is $10^{10}$ to $10^{14}$ Ω·cm.

10. The image forming method according to claim 1, wherein the linear pressure of the transfer onto the second transfer body is higher than the linear pressure of the transfer onto the first transfer body.

11. The image forming method according to claim 10, wherein the linear pressure of the transfer onto the first transfer body is in the range of 10 to 30 g/cm.

12. The image forming method according to claim 11, wherein the linear pressure of the transfer onto the second transfer body is in the range of 70 to 170 g/cm.

13. The image forming method according to claim 12, wherein said additive contains titanium oxide and silicon oxide, and the average particle diameter of said silicon oxide is larger than the particle diameter of the titanium oxide.

14. The image forming method according to claim 13, wherein the amount of toner on said developing carrying member is not more than 0.8 mg/cm$^2$.

15. The image forming method according to claim 1, wherein the absolute value of the change amount of said toner is 15 to 40 μc/g.

16. The image forming method according to claim 1, wherein the additive contains titanium oxide and silicon oxide, and the average particle diameter of the silicon oxide is larger than the particle diameter of the titanium oxide.

17. The image forming method according to claim 16, wherein the amount of toner on the developing carrying member is not more than 0.8 mg/cm$^2$.

18. The image forming method according to claim 1, wherein the volume resistivity of said additive is $10^7$ to $10^9$ Ω·cm.

19. An image forming method comprising the steps of:

developing an electrostatic latent image on an electrostatic latent image carrying member using a toner layer on a developer carrying member;

transferring the developed toner image onto a belt transfer body which is a first transfer body; and transferring the toner image formed on the belt transfer body onto a second transfer body, wherein surface resistance of said belt transfer body is $10^8$ to $10^{15}$ Ω·cm, and said toner is composed of at least resin particles containing a binding resin and coloring material, and an additive, and the additive contains particles whose volume resistance is $10^7$ to $10^{12}$ Ω·cm, wherein the amount of toner of the image developed on said developing carrying member is not more than 0.8 mg/cm$^2$.

and wherein the volume resistance of said additive is higher than the surface resistance of the belt transfer body.

20. The image forming method according to claim 19, wherein a developer is composed of a resin coated carrier and toner.

* * * * *